US011774158B2

(12) United States Patent
Kang et al.

(10) Patent No.: US 11,774,158 B2
(45) Date of Patent: Oct. 3, 2023

(54) REFRIGERATOR, ICE MAKING ASSEMBLY AND METHOD FOR CONTROLLING ICE MAKING ASSEMBLY

(71) Applicant: LG Electronics Inc., Seoul (KR)

(72) Inventors: Sangjun Kang, Seoul (KR); Seunggeun Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 1 day.

(21) Appl. No.: 17/474,451

(22) Filed: Sep. 14, 2021

(65) Prior Publication Data

US 2022/0082316 A1 Mar. 17, 2022

(30) Foreign Application Priority Data

Sep. 14, 2020 (KR) ..... 10-2020-0117706

(51) Int. Cl.
*F25C 5/187* (2018.01)
*F25C 5/20* (2018.01)
*F25C 5/04* (2006.01)

(52) U.S. Cl.
CPC ..... *F25C 5/187* (2013.01); *F25C 5/04* (2013.01); *F25C 5/22* (2018.01); *F25C 2400/10* (2013.01); *F25C 2600/04* (2013.01); *F25C 2700/02* (2013.01)

(58) Field of Classification Search
CPC .... F25C 5/187; F25C 5/04; F25C 5/22; F25C 2400/10; F25C 2600/04; F25C 2700/02
See application file for complete search history.

(56) References Cited

U.S. PATENT DOCUMENTS

2013/0233010 A1* 9/2013 Choi ..... F25C 5/187 62/340
2019/0078824 A1* 3/2019 Yun ..... F25C 1/10
2019/0264972 A1* 8/2019 Kim ..... F25D 11/02
2020/0103155 A1 4/2020 Yun

FOREIGN PATENT DOCUMENTS

JP H06265249 9/1994
JP H09264646 A * 10/1997
KR 100273051 12/2000
KR 20170116897 10/2017
KR 20200036455 4/2020

OTHER PUBLICATIONS

Translated_Yoshikawa (Year: 1997).*
Office Action in Korean Appln. No. 10-2020-0117706, dated Dec. 6, 2021, 14 pages (with English translation).

* cited by examiner

*Primary Examiner* — Elizabeth J Martin
*Assistant Examiner* — Samba N M N Gaye
(74) *Attorney, Agent, or Firm* — Fish & Richardson P.C

(57) ABSTRACT

An ice making assembly includes: an ice maker configured to make ice, an ice bin that has a portion disposed below the ice maker and that is configured to receive the ice from the ice maker, a detection lever that is disposed below the ice maker and that is configured to rotate to thereby detect a volume of the ice in the ice bin, and a driver configured to rotate the ice maker along a moving path between (i) an ice making position at which ice making is performed and (ii) an ice separating position at which ice separation is performed. The detection lever is configured to detect the volume of the ice in the ice bin being full before and after the ice is separated from the ice maker.

20 Claims, 13 Drawing Sheets

REFRIGERATOR, ICE MAKING ASSEMBLY AND METHOD FOR CONTROLLING ICE MAKING ASSEMBLY

CROSS-REFERENCE TO RELATED APPLICATIONS

The present application claims priority under 35 U.S.C. 119 and 35 U.S.C. 365 to Korean Patent Application No. 10-2020-0117706, filed on Sep. 14, 2020, which is hereby incorporated by reference in its entirety.

BACKGROUND

The present disclosure relates to a refrigerator, an ice making assembly, and a method for controlling the ice making assembly.

In general, a refrigerator is a device for storing food in a low temperature state by using low temperature air.

The refrigerator may include a cabinet, in which a storage space is defined, and a refrigerator door that opens or closes the storage space.

The storage space may include a refrigerating space and a freezing space. The refrigerator door may include a refrigerating space door that opens or closes the refrigerating space and a freezing space door that opens or closes the freezing space.

The refrigerator may include an ice making assembly that generates and stores ice using cold air.

The ice making assembly may include an ice maker that generates ice, and an ice bin in which ice separated from the ice maker is stored.

The ice maker may be disposed in any one of the inside of the storage space or the refrigerator door. In addition, the ice bin may be disposed in any one of the inside of the storage space or the refrigerator door.

For user's convenience, a dispenser for dispensing the ice stored in the ice bin may be additionally provided on the refrigerator door.

Korean Patent Publication No. 10-2017-0116897, which is a prior art document, discloses a refrigerator and an ice making device for the refrigerator.

The refrigerator according to the prior art document includes an ice tray, a driver rotating the ice tray, and a full ice detection lever that detects a full ice state in an ice tank.

In the case of the prior art document, only the contents of detecting the full ice state between an ice making process and an ice separating process are disclosed, and thus, after the ice is separated in the ice separation process, there is a limitation in that ice is jammed by the separated ice while the ice tray returns after the ice is separated in the ice separation process.

SUMMARY

Embodiments provide a refrigerator, in which ice jam is prevented while a detection lever for detecting a full ice state operates, an ice making assembly, and a method for controlling the same.

Embodiments also provide a refrigerator, in which a full ice state is detected again even during a return operation after separation of ice is completed to improve accuracy in detection of the full ice state, an ice making assembly, and a method for controlling the same.

Embodiments also provide a refrigerator, in which an ice maker is prevented from being restricted by ice jam due to separated ice, an ice making assembly, and a method for controlling the same.

The ice making assembly according to an aspect may detect whether an ice bin is full before and after ice is separated so as to prevent an ice maker from being restricted by ice separated by the separation of the ice.

In one embodiment, an ice making assembly includes: an ice maker configured to make ice; an ice bin of which at least a portion is disposed below the ice maker, the ice bin being configured to store ice separated from the ice maker; a detection lever disposed below the ice maker to detect a full ice state of the ice bin through rotation thereof; and a driver configured to rotate the ice maker along a moving path between an ice making position, at which ice making is performed, and an ice separating position, at which ice separation is performed.

The full ice state of the ice bin may be detected by the detection lever before and after the ice is separated from the ice maker.

The full ice state of the ice bin may be detected while the ice maker is rotated in a first direction to move from the ice making position to the ice separating position, and the full ice state of the ice bin may be detected while the ice maker is rotated in a second direction that is opposite to the first direction to move from the ice separating position to the ice making position.

The detection lever may be rotated by the driver.

The driver may include: a cam gear; a magnetic lever organically interlocked along a cam surface of the cam gear for the magnetic lever; and a detection element configured to output a first signal and a second signal according to a relative position with respect to the magnetic lever.

When the full ice state of the ice bin is detected, the detection element may be configured to output the first signal.

After the ice making is completed, and the rotation of the ice maker in the first direction starts, when a time taken to output the first signal from the detection element is greater than a predetermined time, it may be determined that the full ice state of the ice bin is not detected.

After the ice making is completed, and the rotation of the ice maker in the first direction starts, when a time taken to output the first signal from the detection element is less than a predetermined time, it may be determined that the full ice state of the ice bin is detected, and the ice maker is rotated in the second direction.

After the ice separating is completed, and the rotation of the ice maker in the second direction starts, when a time taken to output the first signal from the detection element is greater than a predetermined time, it may be determined that the full ice state of the ice bin is not detected.

After the ice separating is completed, and the rotation of the ice maker in the second direction starts, when a time taken to output the first signal from the detection element is less than a predetermined time, it may be determined that the full ice state of the ice bin is detected, and the rotation of the ice maker is stopped.

After the rotation of the ice maker is stopped, whether the second signal is output from the detection element may be determined.

When the second signal is output from the detection element, the ice maker may be rotated in the second direction until the first signal is output again from the detection element.

In another embodiment, a method for controlling an ice making assembly, which includes an ice maker configured to define a space, in which ice is made, and support the made ice, and an ice bin configured to store the ice made in the ice maker, includes: an ice making process of performing ice making in the ice maker; an ice separating process of performing ice separation by rotating the ice maker forward to separate the ice from the ice maker after the ice making is completed; and a return process of rotating the ice maker backward to allow the ice maker to return to an ice making position when the ice making is completed.

In the ice separating process and the return process, a full ice state of the ice bin may be detected.

The ice making assembly may further include: a driver configured to rotate the ice maker; and a detection lever rotated by the driver. The full ice state of the ice bin may be detected by the detection lever.

After the ice making is completed, and the forward rotation of the ice maker starts, when a time taken to output the first signal from the detection element is greater than a predetermined time, it may be determined that the full ice state of the ice bin is not detected, and after the ice making is completed, and the forward rotation of the ice maker starts, when the time taken to output the first signal from the detection element is less than the predetermined time, it may be determined that the full ice state of the ice bin is detected, and the ice maker is rotated backward.

After the ice separating is completed, and the backward rotation of the ice maker starts, when a time taken to output the first signal from the detection element is greater than a predetermined time, it may be determined that the full ice state of the ice bin is not detected, and after the ice separating is completed, and the backward rotation of the ice maker starts, when the time taken to output the first signal from the detection element is less than the predetermined time, it may be determined that the full ice state of the ice bin is detected, and the rotation of the ice maker is stopped.

After the rotation of the ice maker is stopped, whether the second signal is output from the detection element may be determined, and when the second signal is output from the detection element, the ice maker is rotated backward until the first signal may be output from the detection element.

In further another embodiment, a refrigerator includes: a cabinet having a storage space; a refrigerator door configured to open or close the storage space; and an ice making assembly provided in the storage space or the refrigerator door.

The ice making assembly may include: an ice maker configured to make ice; an ice bin configured to store the ice separated from the ice maker; a driver configured to rotate the ice maker; and a detection lever disposed below the ice maker to detect a full ice state of the ice bin through the rotation of the driver.

The ice maker may move along a moving path between an ice making position and an ice separating position at which ice separation is performed.

The detection lever may detect the full ice state of the ice bin while the ice maker moves from the ice making position to the ice separating position, and the ice maker may move from the ice separating position to the ice making position.

When the full ice state is detected while the ice maker moves from the ice making position to the ice separating position, the ice maker may return to the ice making position.

When the full ice state is detected while the ice maker moves from the ice separating position to the ice making position, the rotation of the ice maker may be stopped.

The details of one or more embodiments are set forth in the accompanying drawings and the description below. Other features will be apparent from the description and drawings, and from the claims.

DETAILED DESCRIPTION OF THE EMBODIMENTS

Figure 1:
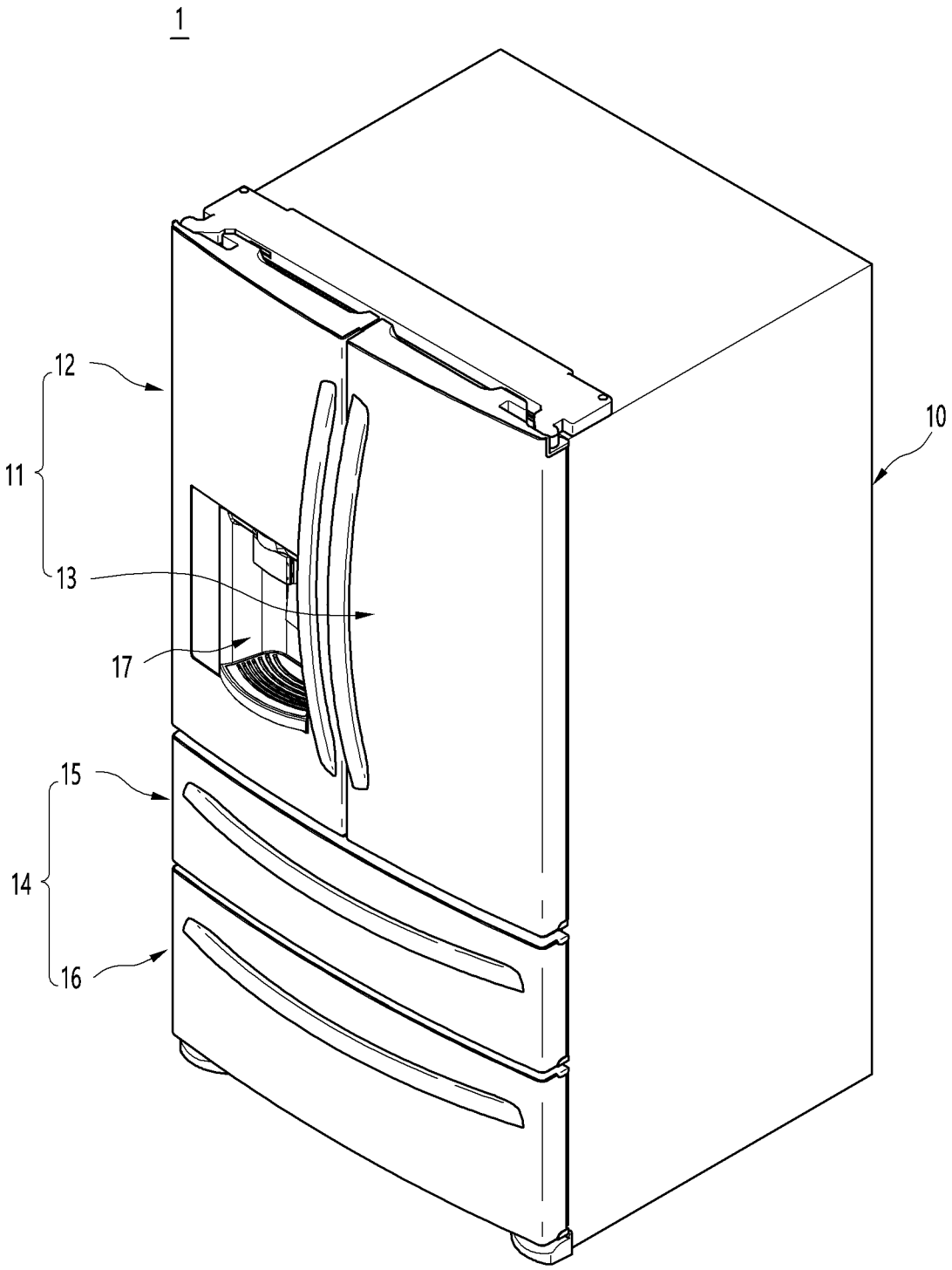
FIG. 1 is a perspective view of a refrigerator according to an embodiment.

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

Figure 2:
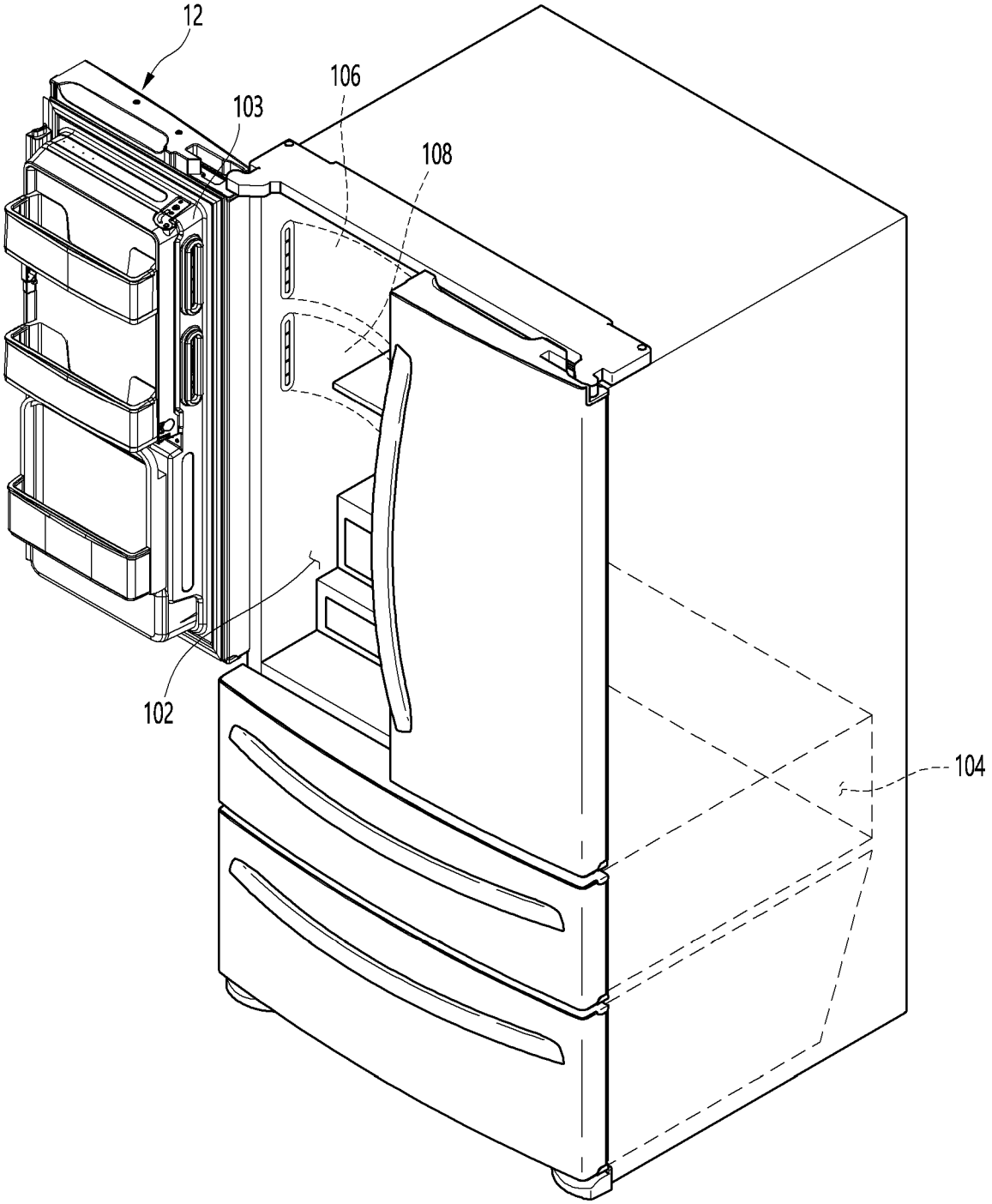
FIG. 2 is a perspective view illustrating a state in which a portion of a refrigerating space door is opened according to an embodiment.

FIG. 1 is a perspective view of a refrigerator according to an embodiment, and FIG. 2 is a perspective view illustrating a state in which a portion of a refrigerating space door is opened according to an embodiment.

Referring to FIGS. 1 and 2, a refrigerator 1 according to this embodiment may include a cabinet 10 defining an outer appearance thereof and refrigerator doors 11 and 14 movably connected to the cabinet 10.

A storage space for storing food is defined inside the cabinet 10. The storage space may include a refrigerating space 102 and a freezing space 104, which is disposed below the refrigerating space 102.

In this embodiment, as an example, a bottom freeze type refrigerator in which the refrigerating space is disposed above the freezing space will be described. However, the spirit of the present disclosure is not limited thereto, and it is to be noted to be equally applied to a refrigerator of a type in which the freezing space and the refrigerating space are disposed in a horizontal direction or a type in which the freezing space is disposed above the refrigerating space.

The refrigerator doors 11 and 14 may include a refrigerating space door 11 that opens or and closes the refrigerating space 102 and a freezing space door 14 that opens or closes the freezing space 104.

The refrigerating space door 11 may include a plurality of doors 12 and 13 disposed horizontally. The plurality of doors 12 and 13 may include a first refrigerating space door 12 and a second refrigerating space door 13 disposed on a right side of the first refrigerating space door 12.

The first refrigerating space door 12 and the second refrigerating space door 13 may move independently.

The freezing space door 14 may include a plurality of doors 15 and 16 disposed vertically. The plurality of doors 15 and 16 may include a first freezing space door 15 and a second freezing space door 16 disposed below the first freezing space door 15.

The first and second refrigerating space doors 12 and 13 may be rotated, and the first and second freezing space doors 15 and 16 may be slid.

Alternatively, one freezing space door 14 may be provided to open or close the freezing space 104. Alternatively, each of the first and second freezing space doors 15 and 16 may be rotated.

A dispenser 17 for dispensing water or ice may be provided in any one of the first and second refrigerating space doors 12 and 13.

In FIG. 1, for example, the dispenser 17 is illustrated in the first refrigerating space door 12. An ice making assembly (to be described later) for generating and storing ice may be provided in any one of the first and second refrigerating space doors.

In this embodiment, the dispenser 17 and the ice making assembly may be provided in the first refrigerating space door 12 or the second refrigerating space door 13.

Thus, hereinafter, as an example, it will be described that the dispenser 17 and the ice making assembly are disposed in the refrigerating space door 11 that is collectively referred to as the first refrigerating space door 12 and the second refrigerating space door 13.

Figure 3:
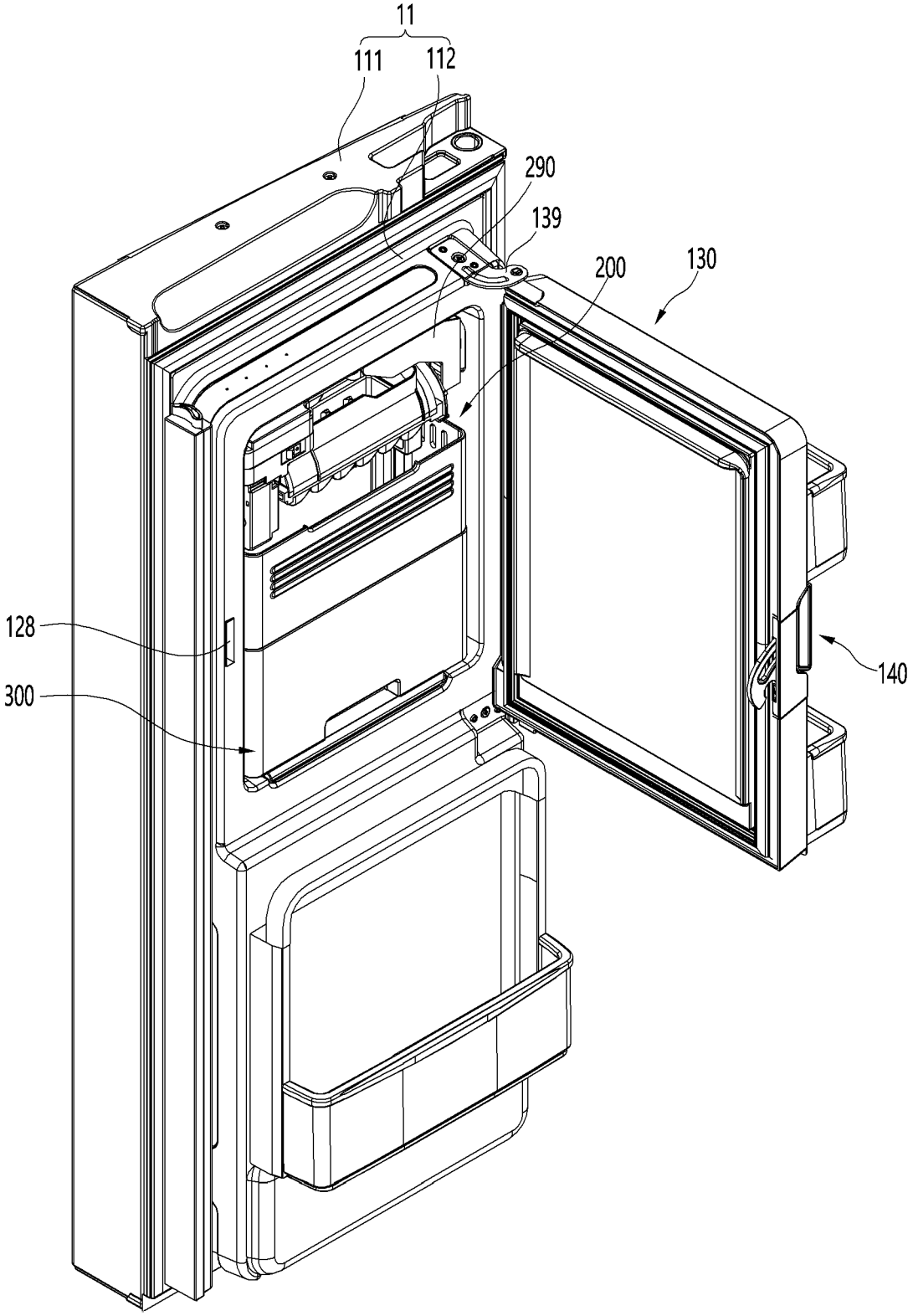
FIG. 3 is a perspective view of a refrigerating space door in a state in which an ice making space door is opened according to an embodiment.
Figure 4:
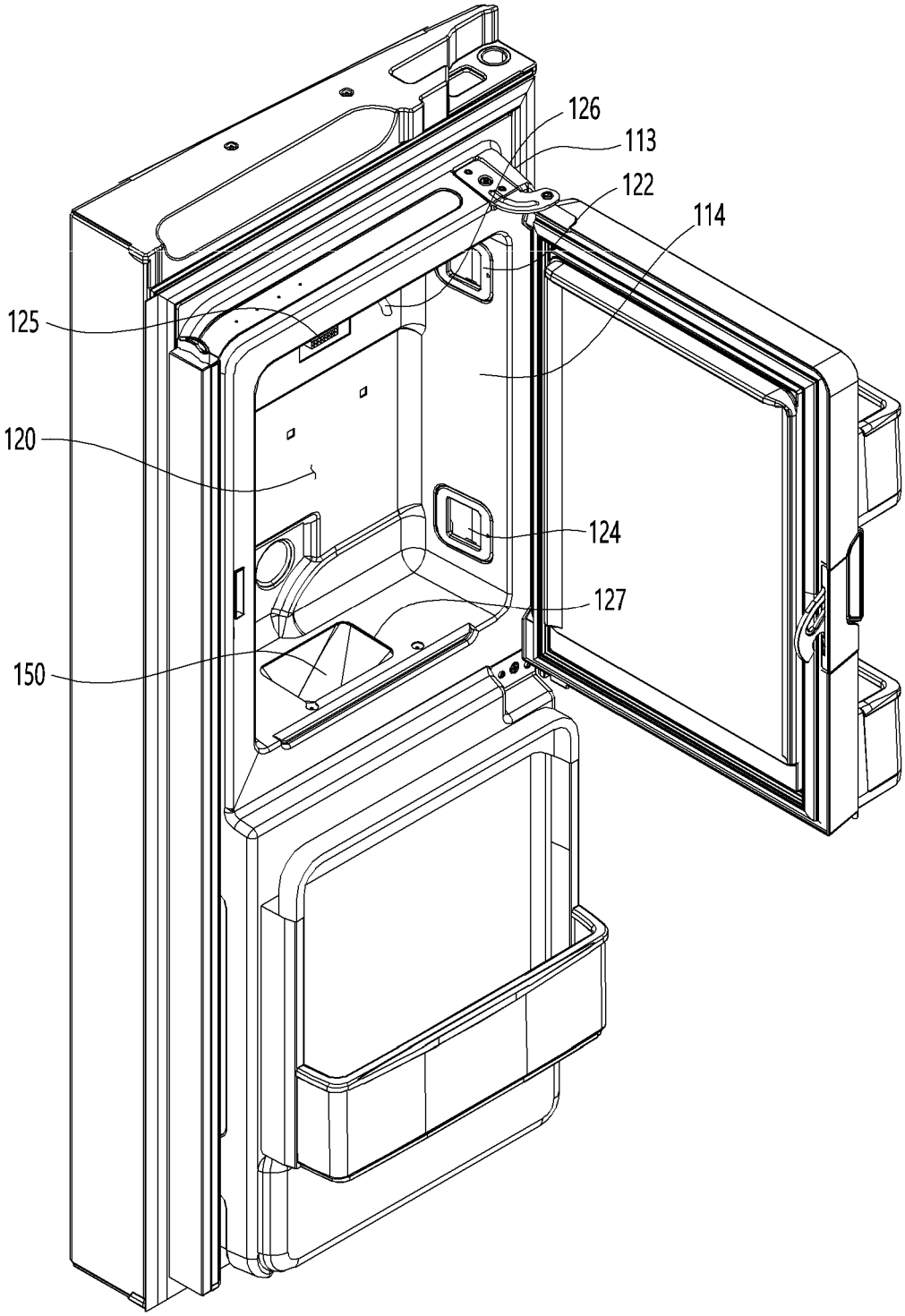
FIG. 4 is a perspective view illustrating a state in which an ice making assembly is removed from the ice making space according to an embodiment.

FIG. 3 is a perspective view of the refrigerating space door in a state in which an ice making space door is opened according to an embodiment, and FIG. 4 is a perspective view illustrating a state in which the ice making assembly is removed from the ice making space according to an embodiment.

Referring to FIGS. 1 to 4, the refrigerating space door 11 may include an outer case 111 and a door liner 112 coupled to the outer case 111.

The door liner 112 may define a rear surface of the refrigerating space door 11.

The door liner 112 may define an ice making space 120.

An ice making assembly 200 for generating and storing ice may be disposed in the ice making space 120.

The ice making space 120 may be opened or closed by the ice making space door 130.

The ice making space door 130 may be rotatably connected to the door liner 112 by a hinge 139. The ice making space door 130 may include a handle 140 to be coupled to the door liner 112 in a state in which the ice making space door 130 closes the ice making space 120.

A handle coupling portion 128 to which a portion of the handle 140 is coupled is disposed on the door liner 112. The handle coupling portion 128 accommodates a portion of the handle 140.

The cabinet 10 may include a main body supply duct 106 for supplying cold air to the ice making space 120 and a main body collection duct 108 for collecting the cold air from the ice making space 120.

The main body supply duct 106 and the main body collection duct 108 may communicate with a space in which an evaporator (not shown) is disposed.

The refrigerating space door 11 may further include a door supply duct 122 for supplying the cold air from the main body supply duct 106 to the ice making space, and a door collection duct 124 for collecting the cold air from the ice making space 120 to the main body collection duct 108.

The door supply duct 122 and the door collection duct 124 may extend from an outer wall 113 of the door liner 112 to an inner wall 114 defining the ice making space 120.

The door supply duct 122 and the door collection duct 124 may be disposed in a vertical direction, and the door supply duct 122 may be disposed above the door collection duct 124. However, in this embodiment, it should be noted that it is not limited to the positions of the door supply duct 122 and the door collection duct 124.

When the refrigerating space door 11 closes the refrigerating space 102, the door supply duct 122 may be aligned with the main body supply duct 106 to communicate with the main body supply duct 106, and the door collection duct 124 may be aligned with the main body collection duct 108 and to communicate with the main body collection duct 108.

A cold air duct 290 for guiding the cold air flowing through the door supply duct 122 to the ice making assembly 200 may be provided in the ice making space 120. A passage through which the cold air can flow is provided in the cold air duct 290, and the cold air flowing through the cold air duct 290 is finally supplied to the ice making assembly 200.

Since the cold air is concentrated toward the ice making assembly 200 by the cold air duct 290, ice may be quickly generated.

The refrigerating space door 11 is provided with a first connector 125 for supplying power to the ice making assembly 200. The first connector 125 is exposed to the ice making space 120. In addition, a water supply tube 126 for supplying water to the ice making assembly 200 is provided in the refrigerating space door 11.

The water supply tube 126 is disposed between the outer case 111 and the door liner 112, and one end of the water supply tube 126 passes through the door liner 112 and is disposed in the ice making space 120.

An opening 127 through which ice is discharged is defined under the inner wall 114 of the door liner 112 defined the ice making space 120. An ice duct 150 communicating with the opening 127 is disposed below the ice making space 120.

Figure 5:
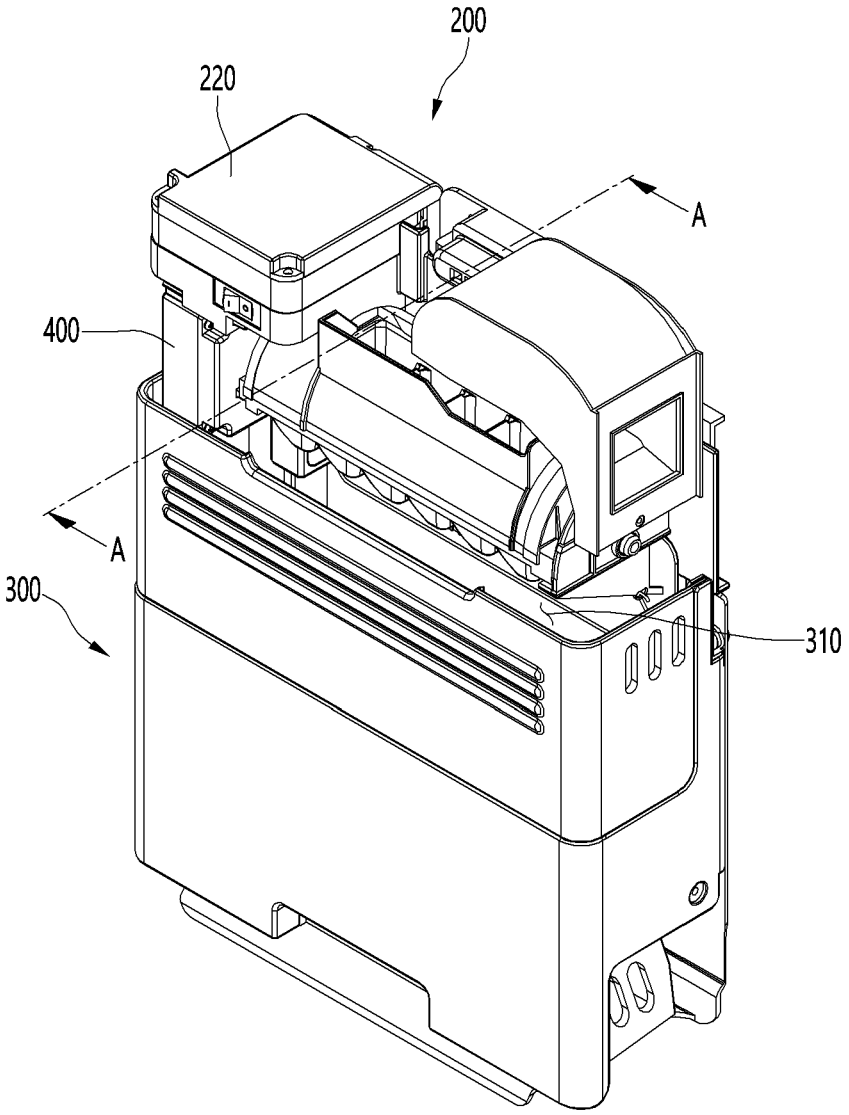
FIG. 5 is a perspective view of the ice making assembly according to an embodiment.
Figure 6:
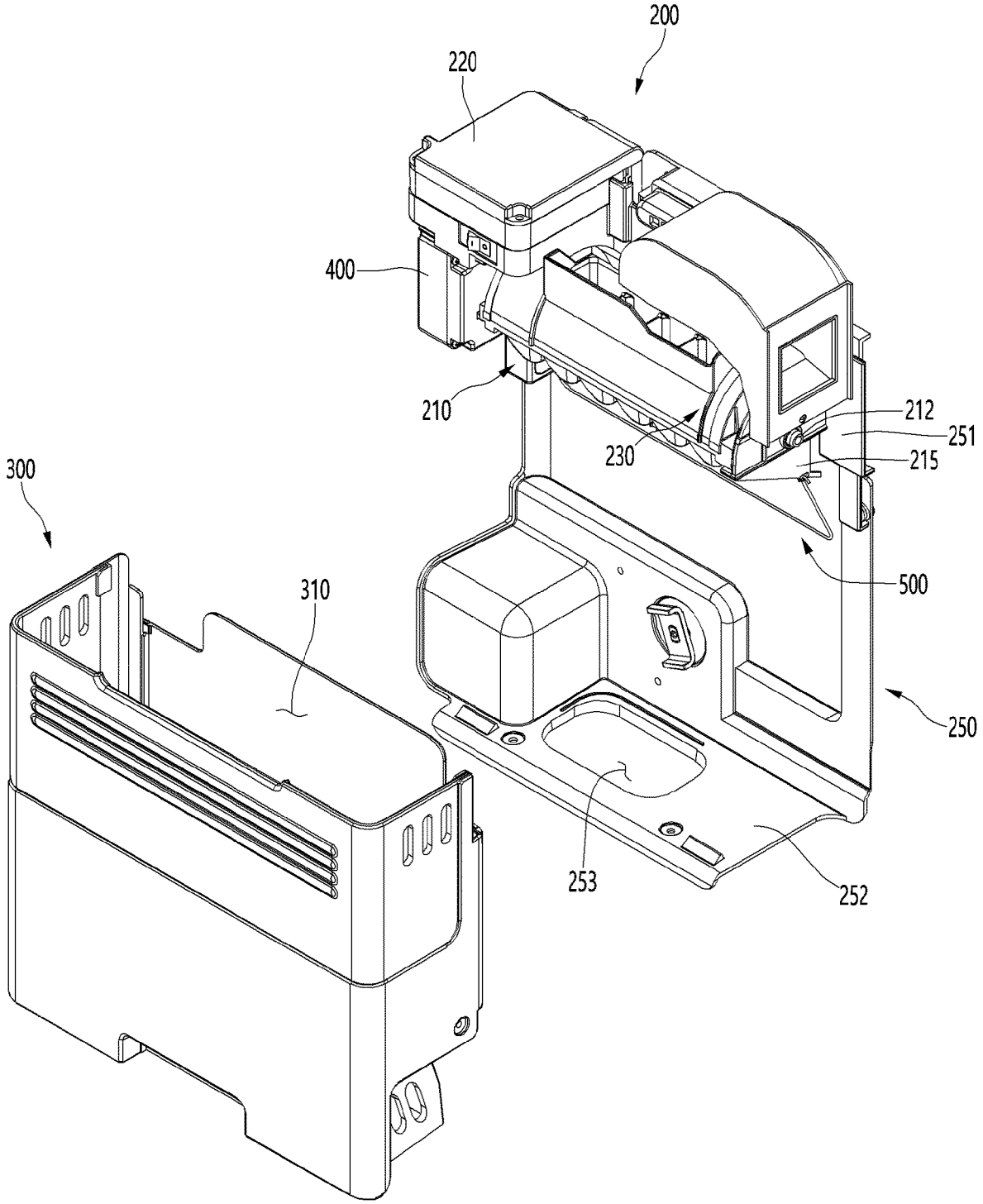
FIG. 6 is a perspective view illustrating a state in which an ice bin is separated from a support mechanism.
Figure 7:
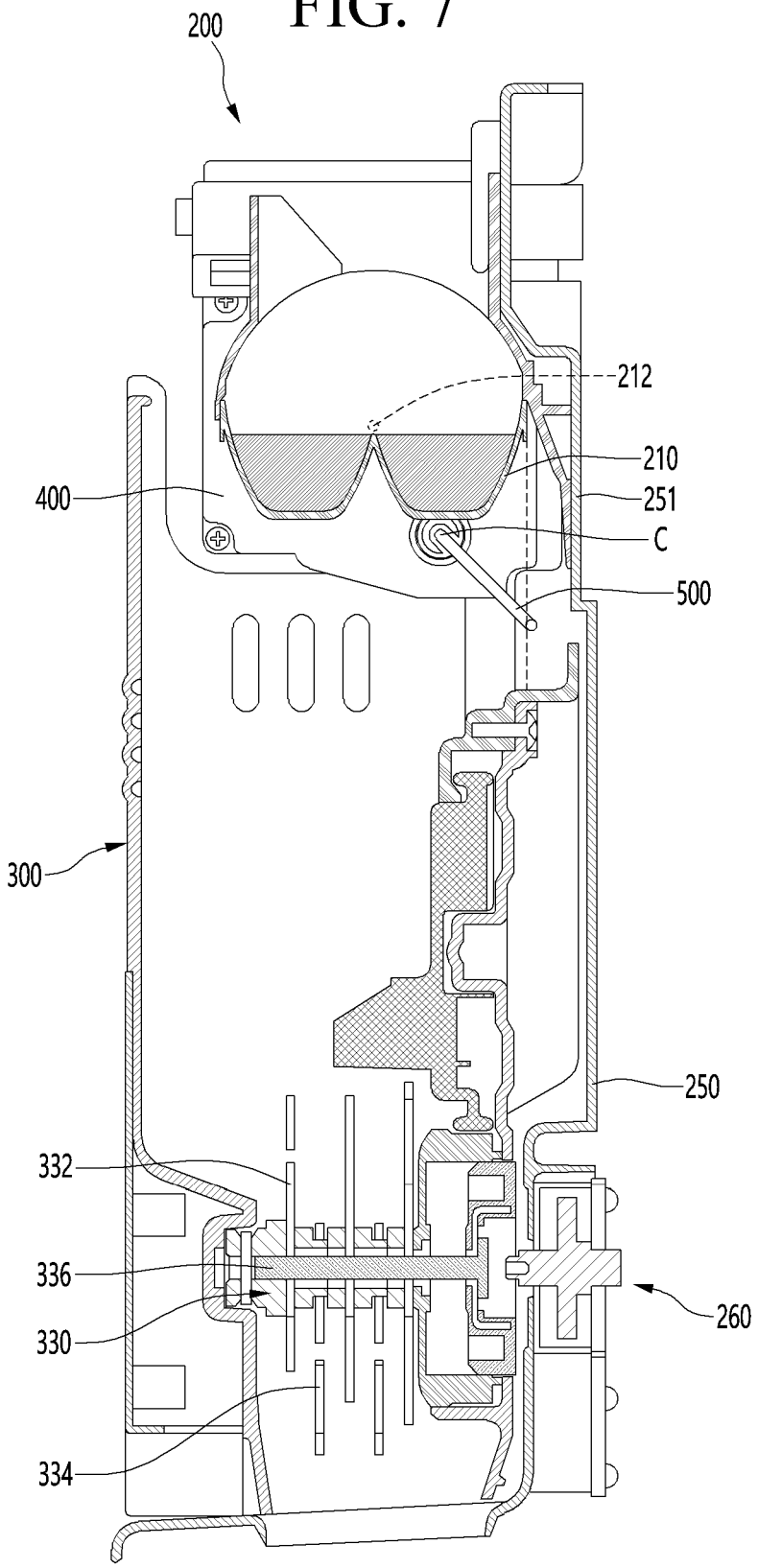
FIG. 7 is a cross-sectional view taken along line A-A of FIG. 5.

FIG. 5 is a perspective view of the ice making assembly according to an embodiment, FIG. 6 is a perspective view illustrating a state in which the ice bin is separated from a support mechanism, and FIG. 7 is a cross-sectional view taken along line A-A of FIG. 5.

Referring to FIGS. 5 to 7, the ice making assembly 200 of this embodiment may include an ice maker 210 that defines a space in which ice is generated and supports the made ice and an ice bin 300 that stores the ice generated in the ice maker 210.

The ice making assembly 200 may further include a driving device 400 that provides power to allow the ice maker 210 to be automatically rotatable, thereby separating ice from the ice maker 210.

Although a controller 220 is provided above the driving device 400, it should be noted that it is not limited to the disposition of the controller 220.

The ice making assembly 200 includes a support mechanism 250 for supporting the ice bin 300, and a support bracket 215 installed on the support mechanism 250 to rotatably support the ice maker 210.

The ice maker 210 is provided with rotation shafts 212 at both sides thereof. The rotation shaft 212 that is disposed at one side may be rotatably connected to the support bracket 215, and the rotation shaft that is disposed at the other side may be rotatably connected to the gear box 400.

A cover 230 that covers the ice maker 210 to prevent water from overflowing when the water is supplied to the ice maker 210 may be provided above the ice maker 210. The cover 230 may be supported by the support bracket 215.

The support mechanism 250 may be provided as a single body or may be provided by coupling two or more bodies to each other.

The ice bin 300 may be seated at one side of the support mechanism 250, and a motor assembly for rotating an ice discharging device 330 provided in the ice bin 300 may be provided at the other side of the support mechanism 250.

The support mechanism 250 may include a bottom wall 252 on which the ice bean 300 is seated. An opening 253 through which the ice discharged from the ice bin 300 passes may be defined in the bottom wall 252.

The ice discharging device 330 in the ice bin 300 may include a rotation shaft 336 that is capable of being rotated by the motor assembly 260, and a rotatable blade 332 coupled to allow the rotation shaft 336 to pass therethrough, and a fixed blade 334 coupled to allow the rotation shaft 336 to pass therethrough and fixed to the ice bin 300.

The ice separated by the ice maker 210 may drop to an upper side of the ice discharging device 330 through an ice inlet 310 of the ice bin 300. The ice stored in the ice bin 300 may be discharged from the ice bin in the form of pieces of ice or ice cube according to a rotation direction of the rotatable blade 332.

The ice making assembly 200 may further include an full ice detection lever 500 (hereinafter referred to as a "detection lever") for detecting a full ice state of the ice bean 300.

One side of the detection lever 500 may be connected to the driving device 400, and the other side of the detection lever 500 may be rotatably connected to the support bracket 215.

The detection lever 500 connected to the driving device 400 may be rotated by the driving device 400 to detect the full ice state of the ice bean 300.

The other side of the detection lever 500 may be rotatably connected to the support bracket 215 below the rotation shaft 212 of the ice maker 210.

Thus, as illustrated in FIG. 7, a rotation center C of the detection lever 500 may be disposed lower than the rotation shaft 212 (rotation center) of the ice maker 210.

In this embodiment, the position of the detection lever 500 in FIG. 7 may be referred to as a "standby position (or first position)" and the position of the ice maker 210 may be referred to as an "ice making position".

The detection lever 500 may be rotated from the standby position to the full ice detection position (or second position) (see FIG. 11) so as to detect the full ice state.

In a state in which the detection lever 500 is disposed at the standby position, at least a portion of the detection lever 500 may be disposed below the ice maker 210.

The entire detection lever 500 may be disposed below the ice maker 210 to prevent the ice maker 210 and the detection lever 500 from interfering with each other while rotating the ice maker 210.

The support mechanism 250 may include a vertical wall 251 extending in the vertical direction.

A horizontal distance between the rotation center C of the detection lever 500 and the vertical wall 251 may be less than a horizontal distance between the rotation shaft 212 of the ice maker 210 and the vertical wall 251.

The detection lever 500 may include a detection body. The detection body may be disposed at the lowermost side during the rotation operation of the detection lever 500.

The detection lever 500 may be in contact with the ice in the ice bin 300 when the ice bin 300 is in the full ice state.

A horizontal distance between the detection body and the vertical wall 251 may be less than the shortest horizontal distance between the ice maker 210 and the vertical wall 251 to prevent the ice is in contact with the detection body while the ice is separated.

That is, in the state in which the detection lever 500 is disposed at the standby position, the detection body may be disposed so as not to overlap the ice maker 210.

Figure 8:
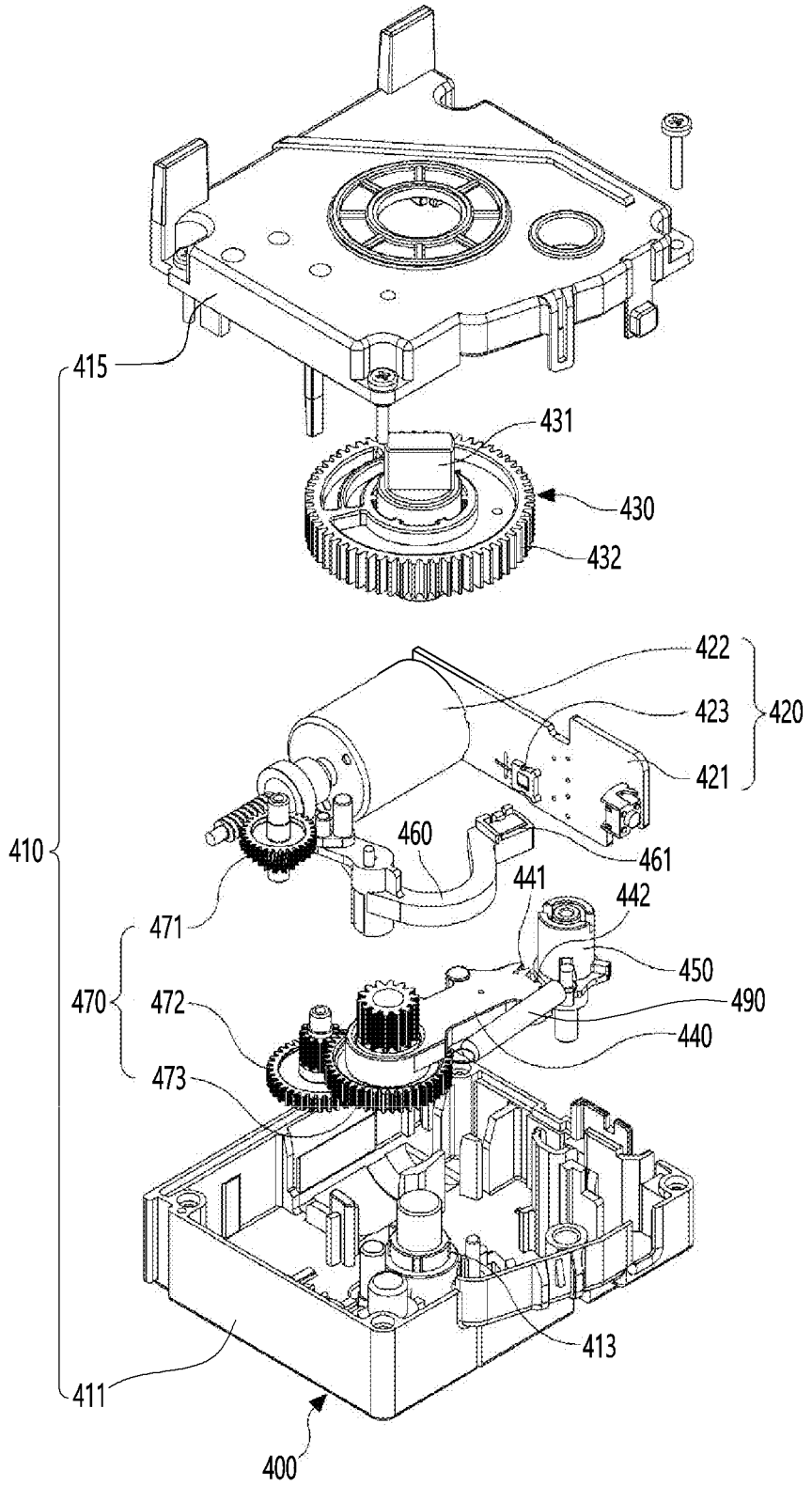
FIG. 8 is an exploded perspective view of a driving device according to an embodiment.
Figure 9:
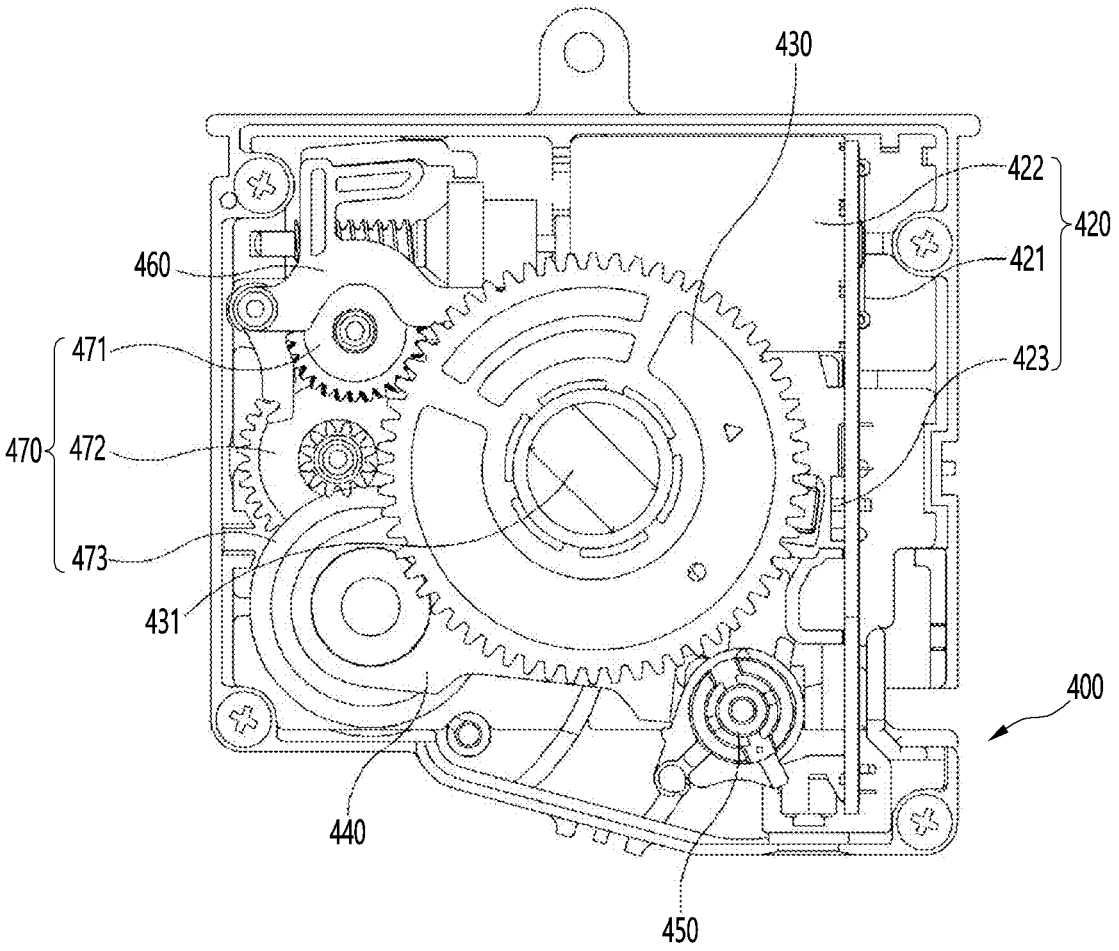
FIG. 9 is a plan view illustrating an internal configuration of the driving device according to an embodiment.

FIG. 8 is an exploded perspective view of the driving device according to an embodiment, and FIG. 9 is a plan view illustrating an internal configuration of the driving device according to an embodiment.

Figure 10:
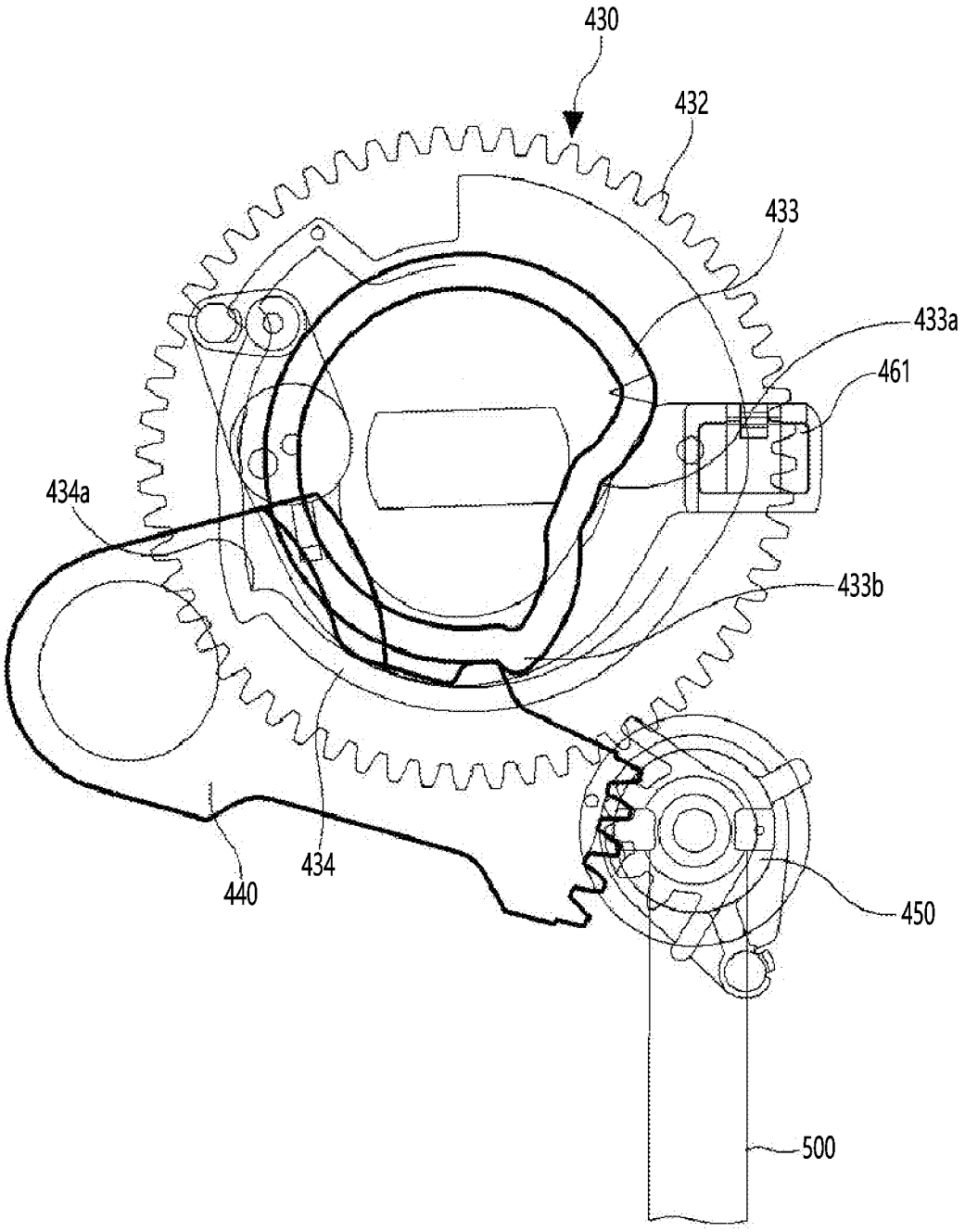
FIG. 10 is a view illustrating a cam gear and an operation lever of the driving device according to an embodiment.

FIG. 10 is a view illustrating a cam gear and an operation lever of the driving device according to an embodiment.

Referring to FIGS. 8 to 10, the driving device 400 may include a driver 420, a cam gear 430 rotating the ice maker 210 while rotated by the driver 420, and an operation lever 440 that is organically interlocked along the cam surface for the detection lever of the cam gear 430.

The driver 400 may further include a lever coupling portion 450 that rotates (swings) the detection lever 500 in the left and right direction while rotated by the operation lever 440.

The driving device 400 may further include a case 410 in which the magnetic lever 460 organically interlocked along the cam surface for the magnetic lever of the cam gear 430, the driver 420, the cam gear 430, the operation lever 440, the lever coupling portion 450, and the magnetic lever 460 are embedded.

The case 410 may include a first case 411 in which the driver 420, the cam gear 430, the operation lever 440, the lever coupling portion 450, and the magnetic lever 460 are embedded, and a second case 415 covering the first case 411.

The driver 420 may include a driving motor 422. The driving motor 422 generates power for rotating the cam gear 430.

The driver 420 may further include a control panel 421 coupled to an inner side of the first case 411. The driving motor 422 may be connected to a control panel 421.

A detection element 423 may be provided on the control panel 421. The detection element 423 may include, for example, a hall IC.

The detection element 423 may output a first signal and a second signal according to a relative position with respect to the magnetic lever 460.

As illustrated in FIG. 10, the cam gear 430 may include a coupling portion 431 to which the ice maker 210 is coupled, a gear portion 432 that transmits power to the driving motor 422, the cam surface 433 for the detection lever, and the cam surface 434 for the magnetic lever.

A cam groove 433*a* for the detection lever, through which the operation lever 440 descends (descends in a direction of the coupling part 431 when viewed in FIG. 10) to rotate the detection lever 500 downward into the ice bin 300, is defined in the cam surface 433 for the detection lever.

A cam groove 434*a* for the magnetic lever, through which the magnetic lever 460 descends (descends in an opposite direction to the coupling portion 431 when viewed in FIG. 10) to separate a contact point between the magnetic lever 460 and the detection element 423, is defined in the cam surface 434 for the magnetic lever.

A reduction gear 470 for reducing rotation force of the driving motor 422 to transmit the reduced rotation force to the cam gear 430 may be provided between the cam gear 430 and the driving motor 422.

The reduction gear 470 may include a first reduction gear 471 connected to the driving motor 422 to transmit power, a second reduction gear 472 engaged with the first reduction gear 471, and a third reduction gear 473 connecting the second reduction gear 472 to the cam gear 430 to transmit the power.

One end of the operation lever 440 is fitted and coupled to the rotation shaft of the third reduction gear 473 so as to be freely rotatable, and a gear 442 formed at the other end of the operation lever 440 is connected to the lever coupling part 450 so as to transmit the power. That is, when the operation lever 440 move, the lever coupling portion 450 rotates.

The lever coupling portion 450 has one end rotatably connected to the operation lever 440 inside the case 410 and the other end protruding to the outside of the case 410 so as to be coupled to the detection lever 500.

That is, the lever coupling portion 450 is provided to protrude from a front surface of the case 410. Thus, the detection lever 500 may be disposed on the front surface of the case 410, and also, there is no need to secure a separate space required for the rotation of the lever coupling portion 450. As a result, the driving device 400 may be reduced in size.

The magnetic lever 460 may include a central portion rotatably provided on the case 410, one end organically interlocked along the cam surface 434 for the magnetic lever of the cam gear 430, and a magnetic portion 461 that is connected to or separated from the detection element 423 at a contact point therebetween.

That is, when the magnetic portion 461 and the detection element 423 are maintained in the contact connection state, the detection element 423 outputs a first signal, and when the magnetic portion 461 and the detection element 423 are separated from the detection element 423 at the contact point therebetween, the detection element 423 outputs a second signal.

As another example, the magnetic portion 461 may not be in contact with the detection element 423. Even in this case, when the magnetic portion 461 moves to a position facing the detection element 423, the detection element 423 may output the first signal. When the magnetic portion 461 is out of the position facing the detection element 423, the detection element 423 may output the second signal.

The first signal may be referred to as a high signal, and the second signal may be referred to as a low signal, and vice and versa.

The driving device 400 may further include an elastic member 490 that provides elastic force so that the lever coupling portion 450 is rotated in one direction. One end of the elastic member 490 may be connected to the lever coupling part 450, and the other end may be fixed to the case 410.

The elastic member 490 may provide, for example, the elastic force for rotating the detection lever 500 from the standby position to the full ice detection position to the detection lever 500.

In the case of the driving device 400, frost may be generated on the outside of the case 410, and when the detection lever 500 is frozen by the frost, the detection lever 500 may not be rotated smoothly.

In order to solve this limitation, in this embodiment, when the detection lever 500 is rotated downward by the cam gear, the freezing of the detection lever 500 may be easily released by momentarily shaking the detection lever 500.

A protrusion 433*b* that allows the detection lever 500 to be vibrated vertically by momentarily rotating the detection lever, which is rotated downward into the ice bin 300, upward may be provided between the cam surface and cam groove for the detection lever of the cam gear 430.

That is, the protrusion 433*b* may protrude outward in a semicircular shape between the cam surface 433 and cam groove 433*a* for the detection lever.

Since the operation lever 440 rides over the semicircular protrusion 433*b*, the operation lever 440 momentarily ascends and then descends.

As the operation lever 440 ascends and descends, the lever coupling portion 450 may be momentarily rotated upward and then downward and then be interlocked with the lever coupling portion 450 to release the freezing due to operation force generated while the detection lever 500 is momentarily shaken vertically.

That is, the effect of vertically shaking the detection lever 500 once by the protrusion 433*b* may be obtained, and the freezing of the detection lever 500 may be easily and conveniently released by this shaking effect.

Figure 11:
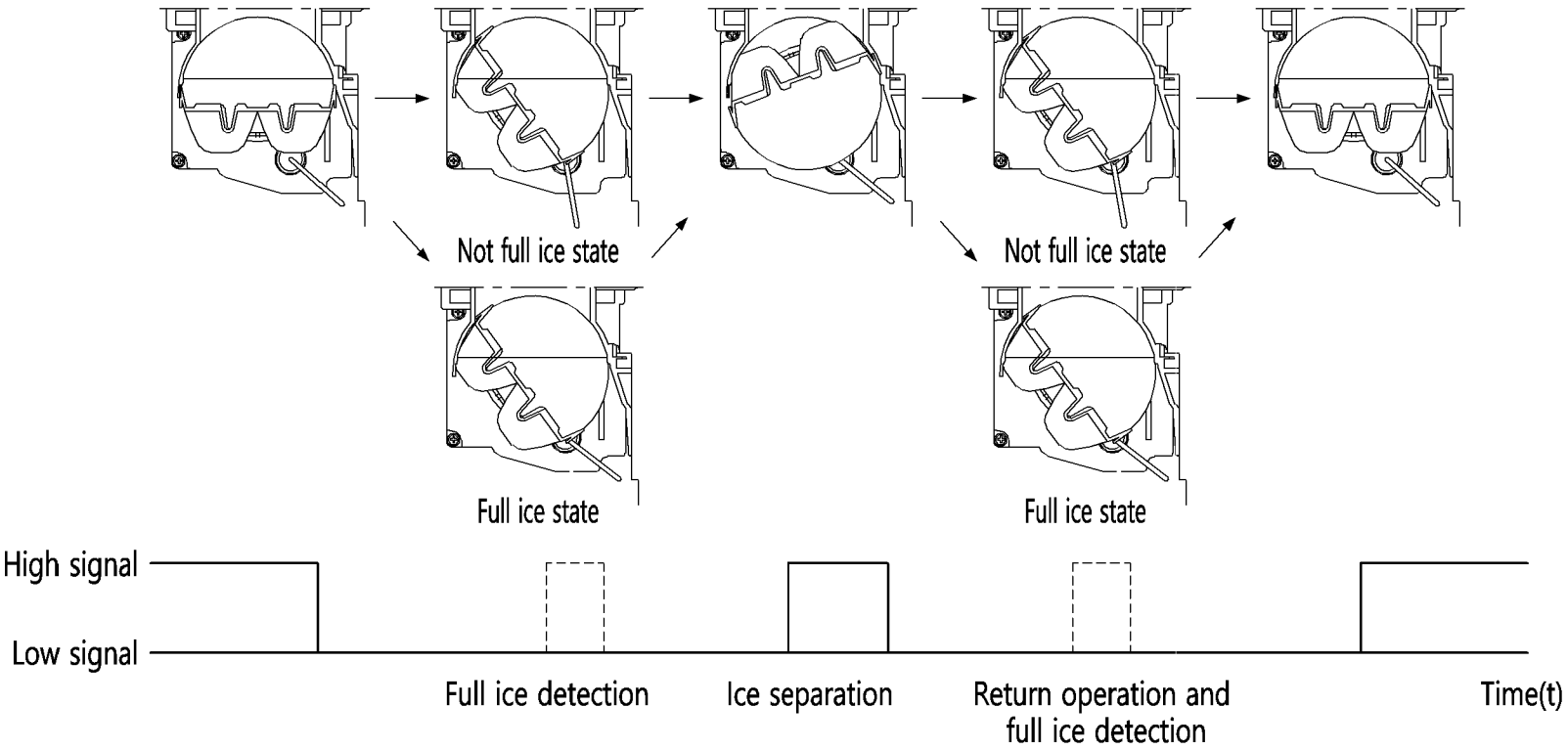
FIG. 11 is a conceptual view illustrating a control operation of an ice making assembly according to an embodiment.
Figure 12:
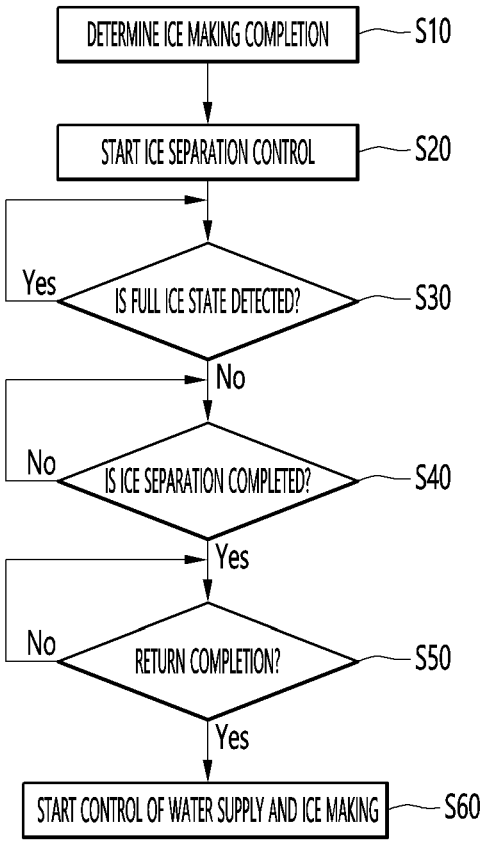
FIGS. 12 and 13 are flowcharts for explaining a method for controlling the ice making assembly according to an embodiment.

FIG. 11 is a conceptual view illustrating a control operation of the ice making assembly according to an embodiment, and FIG. 12 is a flowchart for explaining a method for controlling the ice making assembly according to an embodiment.

Figure 13:
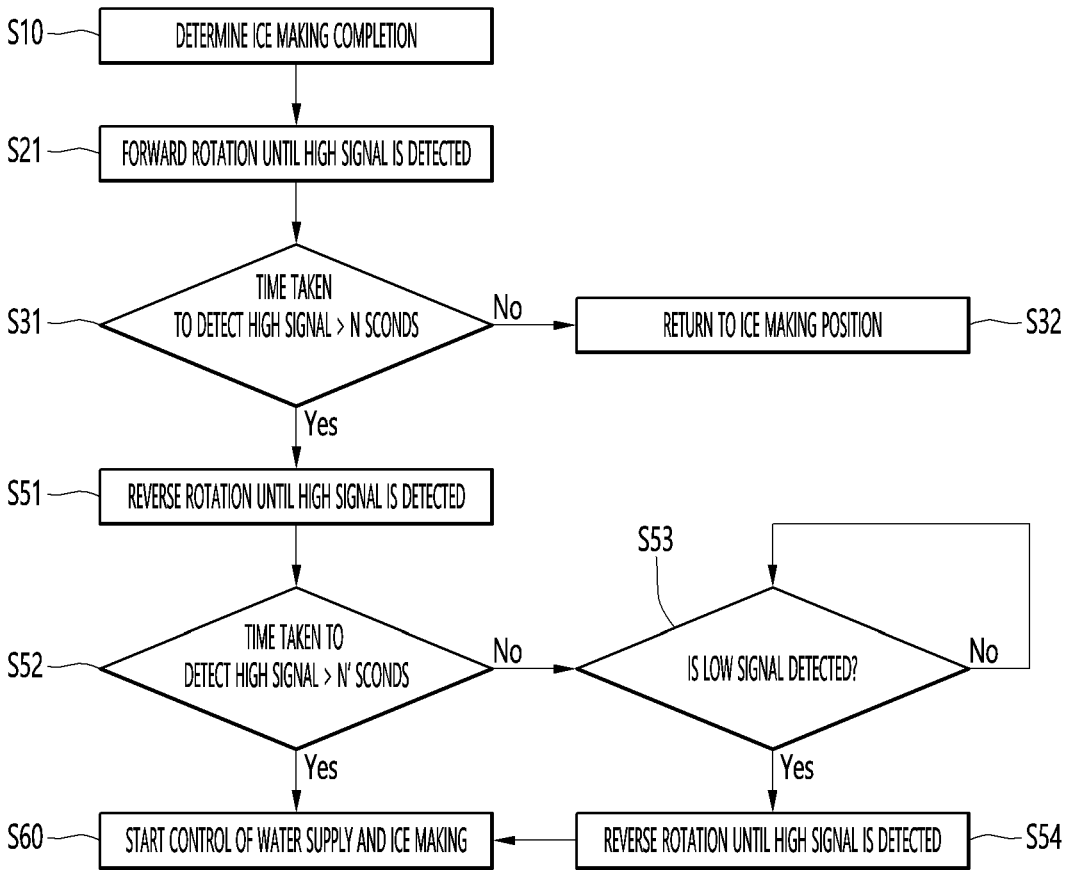

Referring to FIGS. 11 to 13, when it is determined that ice making from the ice maker 210 is completed (S10), a control of ice separation for separating the ice from the ice maker 210 may start (S20).

The ice maker 210 may be rotated in a first direction (a clockwise direction in FIG. 11) by receiving power from the driving motor 422. The rotation in the first direction may be referred to as forward rotation.

Here, the entire ice maker 210 is rotated and twisted, and the ice may be separated from the ice maker 210 by this twisting operation.

That is, during the twisting operation of the ice maker 210, one end and the other end of the ice maker 210 move relative to each other to generate torsion, and thus, the ice is separated from the ice maker 210. Since the twisting operation principle of the ice maker 210 is the same as the known content, a detailed description thereof will be omitted.

The ice maker 210 may continue to be rotated in the first direction until the first signal is output from the detection element 423, and the ice separated by the ice maker 210 drops into the ice bin through an ice inlet 310 of the ice bin 300.

When the ice maker 210 is rotated, the detection lever 500 may be rotated from the standby position to the full ice detection position of FIG. 11 by receiving the power from the driving motor 422.

In this embodiment, the position of the ice maker 210 when the detection lever 500 moves to the full ice detection position may be referred to as an intermediate position.

Here, whether the ice bean 300 is full with ice may be detected through the rotation of the detection lever 500 (S30).

When the ice bin 300 is not filled with ice, the detection lever 500 does not interfere with the ice in the ice bin 300, and thus, the detection lever 500 may be rotated up to the full ice detection position.

In this case, the detection lever 500 may be rotated from the standby position to the full ice detection position only when the ice maker 210 is rotated by a predetermined angle.

When a portion of the operation lever 440 is in contact with the cam surface 433 for the detection lever or aligned with the cam groove 433*a* for the detection lever, a portion of the operation lever 440 is accommodated in the cam groove 433*a* for the detection lever by the elastic force of the elastic member 490. In addition, the operation lever 440 may be rotated while a portion of the operation lever 440 is accommodated in the cam groove 433*a* for the detection lever. When the operation lever 440 is rotated, the rotation force of the operation lever 440 may be transmitted to the lever coupling portion 450, and thus, the detection lever 500 may be rotated in the opposite direction to the operation lever 440.

Thus, if a time until the first signal is output is equal to or greater than a predetermined time, it may be determined that the ice bin 300 is not in the full ice state. When the ice bin 300 is not in the full ice state, the ice maker 210 may be further rotated from the intermediate position in the first direction to the ice separation position as illustrated in FIG. 11.

The Ice may be separated from the ice maker 210, and the ice separated from the ice maker 210 may drop into the ice bin 300 to complete the ice separation (S40).

While the ice maker 210 is further rotated in the first direction, a portion of the operation lever 440 may move out of the cam groove 433*a* for the detection lever and be rotated from the full ice detection position to the standby position while being in contact with the cam surface 433 for the detection lever again.

Since the detection lever 500 may vertically overlap the ice maker 210 while the detection lever 500 is rotated to the full ice standby position, the detection lever 500 may return to the standby position before the ice maker 210 is rotated up to the ice separation position.

Thus, the ice separated from the ice maker 210 may smoothly drop into the ice bin 300 without interfering with the detection lever 500.

That is, when it is determined that the ice making is complete, the ice maker 210 may be rotated in the first direction from the ice making position to the ice separating position. Here, the ice maker 210 may be rotated until the first signal is output from the detection element 423, and a time taken from the start of the forward rotation until the first signal is output is greater than a predetermined time (n seconds), it may be determined that the ice bin 300 is not full with ice (S31).

The predetermined time (n seconds) may be a minimum time until the ice maker 210 moves from the ice making position to the ice separating position.

When the ice maker 210 is rotated in the first direction to separate ice from the ice maker 210 in the full ice state of the ice bin 300, the detection lever 500 is in contact with the ice stored in the ice bin 300.

In this case, even when the ice maker 210 moves to the intermediate position, the detection lever 500 does not move from the standby position to the full ice detection position due to the interference with the ice.

In this case, the first signal may be output from the detection element 423 before the ice maker 210 reaches the ice separation position.

That is, when the time taken from the start of the forward rotation until the first signal is output is less than the predetermined time (n seconds), it is determined that the ice bean 300 is in the full ice state.

When it is determined that the ice bin 300 is in the full ice state, the ice maker 210 may not be rotated further in the first direction from the intermediate position, but be rotated in a second direction opposite to the first direction to return to the ice making position (S32).

When the ice separation of the ice maker 210 is completed, a return operation for returning to the ice making position may be performed (S50).

The ice maker 210 may start to be rotated in the second direction from the ice separation position. The rotation in the second direction may be referred to as a reverse rotation.

Here, when the ice maker 210 is rotated, the detection lever 500 may be rotated from the standby position to the full ice detection position by receiving the power from the driving motor 422.

That is, even when the ice maker 210 is reversely rotated from the ice separation position to return to the ice making position, whether the ice bin 300 is full with ice may be detected through the rotation of the detection lever 500 once again.

The ice maker 210 may start to be rotated in the second direction from the ice separation position and may continue to be rotated until the first signal is output from the detection element 423 (S51).

When the ice bin 300 is not filled with ice, the detection lever 500 may not interfere with the ice in the ice bin 300 and be rotated to the full ice detection position. Thus, when the ice maker reaches the ice making position, the first signal may be output from the detection element 423.

That is, if a time taken until the first signal is output from the detection element 423 is greater than a predetermined time (n' seconds) (S52), it is determined that the ice maker 210 returns to the ice making position in the state in which the ice bin 300 is not filled with ice, and thus, a control of water supply and ice making may start (S60).

The predetermined time (n' seconds) may be a minimum time required for the ice maker 210 to move from the ice separating position to the ice making position.

If the time taken until the first signal is output from the detection element 423 is less than the predetermined time (n' seconds), it may be determined that the ice bin 300 is in the full ice state (S52).

That is, when the ice maker 210 is rotated in the second direction in the full ice state of the ice bin 300, if the detection lever 500 is in contact with the ice stored in the ice bin 300, the first signal is output from the detection element 423. Here, a time taken from when the ice maker 210 starts to be rotated reversely until the first signal is output from the detection element 423 is less than the predetermined time (n' seconds).

In addition, as the ice bin 300 is filled with ice, the detection lever 500 is stopped in a state of being in contact with the ice, and thus, the rotation force is not connected to the operation lever 400 and the magnetic lever 460. As a result, the detection element 423 is continuous to output the first signal.

When the ice bin 300 is detected to be full with ice, an operation of the driving motor 422 may be stopped, and thus, the ice maker 210 may be continuously disposed at the intermediate position.

When the ice maker 210 is disposed at the intermediate position, cold air is supplied to the ice bin 300 disposed below the ice maker 210 to prevent the ice accommodated in the ice maker 210 from being melted.

However, if necessary, when the ice bin 300 is detected to be in the full ice state, a control may be performed so that the ice maker 210 returns to the ice making position as it is.

When the full ice state of the ice bin 300 is released, the detection element 423 outputs the second signal. When the detection element 423 outputs the second signal, the driving motor 422 may continuously rotate the ice maker 210 in the second direction to output the first signal from the detection element 423.

That is, after the ice bin 300 is detected to be full with ice, whether the detection element 423 outputs the second signal may be continuously determined (S53).

When the detection element 423 outputs the second signal, it is determined that the full ice state of the ice beam 300 is released, and thus, the ice maker 210 is rotated in the second direction until the first signal is output from the detection element 423 (S54).

When the first signal is output from the detection element 423, it is determined that the ice maker 210 returns to the ice making position, and accordingly, the control of the water supply and the ice making may start (S60).

In other words, the ice maker 210 according to an embodiment may start the forward rotation when the ice making is completed to detect the full ice state by the detection lever 500, and after reaching the ice separation position to separate the ice, even while the ice maker 210 may start the reverse rotation to return to the ice making position, the full ice state may be detected once again by the detection lever 500.

That is, since the full ice state of the ice bin 300 is detected twice before and after the ice is separated, it is possible to more accurately detect whether the ice bin 300 is full with ice.

According to the proposed invention, the ice jam may be prevented while the detection lever for detecting the full ice state operates.

In addition, the full ice state may be detected in two stages after the completion of the ice making and after the completion of the ice separation.

In addition, the separated ice during the final ice separation may be disposed in a section of the return rotation operation of the ice maker to prevent the ice from getting on the tray of the ice maker.

In addition, a separate configuration for restricting the detection lever in the return operation after the ice separation is completed may be removed to reduce material costs.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An ice making assembly comprising:

an ice maker configured to make ice;

an ice bin that has a portion disposed below the ice maker and that is configured to receive the ice from the ice maker;

a detection lever that is disposed below the ice maker and that is configured to rotate to thereby detect a volume of the ice in the ice bin; and a driver configured to rotate the ice maker along a moving path between (i) an ice making position at which ice making is performed and (ii) an ice separating position at which ice separation is performed, wherein, based on the ice maker being rotated in a first direction to move from the ice making position to the ice separating position, the detection lever is configured to rotate in the first direction to detect the volume of the ice in the ice bin being full, and wherein, based on the ice maker being rotated in a second direction opposite to the first direction to move from the ice separating position to the ice making position, the detection lever is configured to rotate in the first direction from a standby position to detect the volume of the ice in the ice bin being full.

2. The ice making assembly of claim 1, wherein, based on the volume of the ice in the ice bin not being detected full, the ice maker is additionally rotated in the first direction to move to the ice separating position, and the detection lever is configured to move in the second direction to return to the standby position.

3. The ice making assembly of claim 2, wherein the driver is configured to rotate the detection lever.

4. The ice making assembly of claim 3, wherein the driver comprises:

a cam gear;

a magnetic lever connected along a cam surface of the cam gear; and a detection element including a sensor and configured to output a first signal and a second signal according to a position of the detection element with respect to the magnetic lever.

5. The ice making assembly of claim 4, wherein the detection element is configured to, based on the volume of the ice in the ice bin being detected full, output the first signal.

6. The ice making assembly according to claim 4, wherein the detection lever is configured to, based on (i) a time taken to output the first signal from the detection element being greater than a predetermined time, (ii) the ice making being completed, and (iii) the ice maker rotating in the first direction, detect the volume of the ice in the ice bin not being full.

7. The ice making assembly of claim 4, wherein the detection lever is configured to, based on (i) a time taken to output the first signal from the detection element being less than a predetermined time, (ii) the ice making being completed, and (iii) the ice maker rotating in the first direction, detect the volume of the ice in the ice bin being full, and the ice maker is configured to rotate in the second direction.

8. The ice making assembly of claim 4, wherein the detection lever is configured to, based on (i) a time taken to output the first signal from the detection element being greater than a predetermined time, (ii) the ice separating being completed, and (iii) the ice maker rotating in the second direction, detect the volume of the ice in the ice bin not being full.

9. The ice making assembly of claim 4, wherein the detection lever is configured to, based on (i) a time taken to output the first signal from the detection element being less than a predetermined time, (ii) the ice separating being completed, and (ii) the ice maker rotating in the second direction, detect the volume of the ice in the ice bin being full, and the ice maker is configured to stop rotating.

10. The ice making assembly of claim 9, wherein the detection element is configured to, after the ice maker stops rotating, output the second signal.

11. The ice making assembly of claim 10, wherein the ice maker is configured to, based on the second signal being output from the detection element, rotate in the second direction until the first signal is output from the detection element.

12. A method for controlling an ice making assembly that includes (i) an ice maker defining a space in which ice is made and supporting the ice and (ii) an ice bin configured to receive the ice from the ice maker, the method comprising:

an ice making process of performing ice making in the ice maker;

an ice separating process of performing ice separation by rotating the ice maker forward to separate the ice from the ice maker after the ice making is completed;

a first detecting process of detecting a volume of the ice in the ice bin being full by rotating a detection lever forward while the ice maker rotates forward;

a return process of rotating, based on the ice making being completed and the volume of the ice in the ice bin not being detected full, the ice maker backward to move the ice maker to an ice making position; and a second detecting process of detecting the volume of the ice in the ice bin being full by rotating the detection lever forward in the return process.

13. The method of claim 12, wherein the ice making assembly further comprises:

a driver configured to rotate the ice maker; and the detection lever rotated by the driver, wherein the detection lever is configured to detect the volume of the ice in the ice bin being full.

14. The method of claim 13, wherein the driver comprises:

a cam gear; and a magnetic lever interlocked along a cam surface of the cam gear, wherein the driver further comprises a detection element including a sensor and configured to output a first signal and a second signal according to a position of the detection element with respect to the magnetic lever.

15. The method of claim 14, wherein the detection lever is configured to, based on (i) a time taken to output the first signal from the detection element being greater than a predetermined time, (ii) the ice making being completed, and (iii) the ice maker rotating forward, detect the volume of the ice in the ice bin not being full, and wherein the detection lever is configured to, based on (i) the time taken to output the first signal from the detection element being less than the predetermined time, (ii) the ice making being completed, and (iii) the ice maker rotating forward, detect the volume of the ice in the ice bin being full, and the ice maker is configured to rotate backward.

16. The method of claim 15, wherein the detection lever is configured to, based on (i) the time taken to output the first signal from the detection element being greater than a predetermined time, (ii) the ice separating being completed, and (iii) the ice maker rotating backward, detect the volume of the ice in the ice bin not being full, and wherein the detection lever is configured to, based on (i) the time taken to output the first signal from the detection element being less than the predetermined time, (ii) the ice separating being completed, and (iii) the ice maker rotating backward, detect the volume of the ice in the ice bin being full, and the ice maker is configured to stop rotating.

17. The method of claim 16, wherein the detection element is configured to, after the ice maker stops rotating, output the second signal, and wherein the ice maker is configured to, based on the second signal being output from the detection element, rotate backward until the first signal is output from the detection element.

18. A refrigerator comprising:

a cabinet defining a storage space;

a refrigerator door configured to open or close the storage space; and an ice making assembly provided in the storage space or the refrigerator door, wherein the ice making assembly comprises:

an ice maker configured to make ice;

an ice bin configured to receive the ice from the ice maker;

a driver configured to rotate the ice maker; and a detection lever that is disposed below the ice maker and that is configured to detect a volume of the ice in the ice bin being full through the rotation of the driver, wherein the ice maker is configured to move along a moving path between (i) an ice making position at which ice making is performed and (ii) an ice separating position at which ice separation is performed, and wherein the detection lever is configured to, based on the ice maker being rotated in a first direction to move from the ice making position to the ice separating position, detect the volume of the ice in the ice bin being full, by rotating in the first direction, and wherein the detection lever is configured to, based on the ice maker being rotated in a second direction opposite to the first direction to move from the ice separating position to the ice making position, detect the volume of the ice in the ice bin being full, by rotating in the first direction.

19. The refrigerator of claim 18, wherein the ice maker is configured to, based on the volume of the ice in the ice bin being full being detected by the detection lever while the ice maker moves from the ice making position to the ice separating position, move to the ice making position.

20. The refrigerator of claim 18, wherein the ice maker is configured to, based on the volume of the ice in the ice bin being full being detected while the ice maker moves from the ice separating position to the ice making position, stop rotating.

* * * * *